US011965724B2

(12) United States Patent
Hild et al.

(10) Patent No.: US 11,965,724 B2
(45) Date of Patent: Apr. 23, 2024

(54) PROGRAMMING DEVICE

(71) Applicant: KRAUSS-MAFFEI WEGMANN GMBH & CO. KG, Munich (DE)

(72) Inventors: Simon Hild, Kassel (DE); Lars Schneider, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 17/912,094

(22) PCT Filed: Mar. 16, 2021

(86) PCT No.: PCT/EP2021/056702

§ 371 (c)(1),
(2) Date: Sep. 16, 2022

(87) PCT Pub. No.: WO2021/191004

PCT Pub. Date: Sep. 30, 2021

(65) Prior Publication Data

US 2023/0175826 A1 Jun. 8, 2023

(30) Foreign Application Priority Data

Mar. 27, 2020 (DE) ..... 10 2020 108 567.2

(51) Int. Cl.
*F42C 17/04* (2006.01)
*F41A 9/39* (2006.01)

(52) U.S. Cl.
CPC ..... *F42C 17/04* (2013.01); *F41A 9/39* (2013.01)

(58) Field of Classification Search
CPC ..... F42C 17/04
USPC ..... 89/6, 6.5
See application file for complete search history.

(56) References Cited

U.S. PATENT DOCUMENTS

| | | | | |
|---|---|---|---|---|
| 1,332,763 A | | 3/1920 | Schneider | |
| 3,494,251 A | | 2/1970 | Albrecht et al. | |
| 5,198,600 A | * | 3/1993 | E'Nama | F41C 27/00 42/105 |
| 5,343,795 A | | 9/1994 | Ziemba et al. | |
| 6,138,547 A | * | 10/2000 | Larsson | F42C 17/04 102/270 |

(Continued)

FOREIGN PATENT DOCUMENTS

| | | |
|---|---|---|
| DE | 199 01 673 A1 | 7/2000 |
| DE | 100 20 775 A1 | 4/2001 |

(Continued)

OTHER PUBLICATIONS

International Search Report dated Sep. 17, 2021 which pertains to PCT Application No. PCT/EP2021/056702 filed Mar. 16, 2021, 9 pages.

(Continued)

*Primary Examiner* — Bret Hayes
(74) *Attorney, Agent, or Firm* — Thompson Hine LLP

(57) ABSTRACT

A programming device for programming of munition bodies, including a retaining device to which a programming head for transmitting programming data to the munition bodies is fastened, the programming head begin designed as an interchangeable programming head module. The invention further relates to a projectile rammer having a programming device and to a method for programming a munition body.

15 Claims, 4 Drawing Sheets

(56) References Cited

U.S. PATENT DOCUMENTS

| | | | | |
|---|---|---|---|---|
| 6,170,377 | B1 * | 1/2001 | Larsson | F42C 17/04 89/6 |
| 6,176,168 | B1 * | 1/2001 | Keil | H01F 38/14 89/6 |
| 6,289,780 | B1 | 9/2001 | Heldmann | |
| 7,021,187 | B1 * | 4/2006 | Grassi | F42C 17/04 89/6.5 |
| 8,534,180 | B2 | 9/2013 | Becker et al. | |
| 8,839,705 | B2 * | 9/2014 | Chiappini | F42C 17/00 89/6 |
| 11,060,830 | B2 * | 7/2021 | Larsson | F42C 11/065 |
| 2003/0047063 | A1 * | 3/2003 | Sullivan | F41A 3/54 89/6.5 |
| 2005/0061191 | A1 | 3/2005 | Dietrich et al. | |
| 2006/0027127 | A1 * | 2/2006 | Cerovic | F41H 13/0018 102/502 |
| 2011/0297031 | A1 | 12/2011 | Fu et al. | |
| 2012/0011991 | A1 | 1/2012 | Magnan et al. | |

FOREIGN PATENT DOCUMENTS

| | | | | | |
|---|---|---|---|---|---|
| DE | 10 2008 052 074 | A1 | | 4/2010 | |
| DE | 10 2014 016 340 | B3 | | 8/2015 | |
| EP | 1 020 700 | A2 | | 7/2000 | |
| EP | 2 400 257 | A1 | | 12/2011 | |
| GB | 185902271 | A | | 3/1860 | |
| GB | 578621 | A | * | 7/1946 | F42C 17/00 |
| WO | 2002/077564 | A1 | | 10/2002 | |
| WO | 2019/066697 | A1 | | 4/2019 | |
| WO | 2019/0147620 | A1 | | 8/2019 | |

OTHER PUBLICATIONS

International Preliminary Report on Patentability dated Oct. 6, 2022 which pertains to PCT Application No. PCT/EP2021/056702 filed Mar. 16, 2021, 14 pages.

* cited by examiner

PROGRAMMING DEVICE

This application is a national stage filing of International (PCT) Application No. PCT/EP2021/056702, corresponding to International Publication No. WO 2021/191004 filed on Mar. 16, 2021, which in turn claims priority to German Application No. 10 2020 108 567.2 filed on Mar. 27, 2020. The entire contents of both of those applications are hereby incorporated by reference.

The disclosure relates to a programming device for the programming of, in particular large-caliber, munition bodies, having a holding device to which a programming head for the transmission of programming data to the munition body is fastened. The disclosure further relates to a projectile rammer having a programming device, and to a method for programming munition bodies.

BACKGROUND

Corresponding programming devices are used to program programmable munition bodies prior to firing. The programming of a corresponding munition body means that in the case of an explosive projectile, for example, the detonation times are programmed, or in the case of guided munition bodies, GPS data or other boundary parameters are also programmed.

Programmable munition bodies are usually large-caliber munition bodies which are fired from artillery guns or also from warships, for example, and which can achieve ranges of more than 50 km. For example, they may be munition bodies with a caliber of 127 or 155 mm. Corresponding munition bodies usually have a programmable detonator to which corresponding programming data are sent via the programming head of the programming device.

In order to ensure reliable data transmission, the programming head and the munition body being programmed must be adapted to one another. Munition bodies which can be programmed in a contactless manner via an inductive programming device are known in the art, for example. A programming device of this kind is shown in EP 1 020 700 B1, for example. With this programming device, the fuse arranged at the tip of the projectile must be introduced into the programming head of the programming device and the corresponding programming data is then transferred from the programming head to the munition body in a contactless manner. In order to move the programming head accordingly and to displace it from the front to the tip of the munition body, the programming head is arranged on a holding device which allows a corresponding movement of the programming head in the direction of the longitudinal axis of the munition body.

Although appropriately configured munition bodies can be reliably programmed with this programming device, said programming device is limited to the programming of munition bodies, whose programming interfaces are located at the tip and which can be inductively programmed. Munition bodies of another type may not be able to be reliably programmed using the programming device.

What happens in practice is that a magazine of a military vehicle is fitted with different types of munition bodies, with a suitable type of munition body being selected depending on the threat level or the target being engaged. Particularly when selecting different types of munition bodies, problems can then arise in the case of programming devices known in the art, however, since their range of application is usually limited to the programming of only one type of munition body.

SUMMARY

Against this background, the problem addressed by the disclosure is that of specifying a programming device with which different types of munition bodies can be programmed and which, to this extent, allows a broader application range.

This problem is solved in the case of a programming device of the kind referred to above, in that the programming head is configured as an exchangeable programming head module.

The exchangeability of the programming head makes it possible for different types of munition bodies to be programmed using the same programming device too. Different programming heads can be provided, wherein each individual programming head may be suitable for programming a particular type of munition body. The various programming heads may be used selectively depending on the type of munition body being programmed, so that a large number of different types of munition bodies can be reliably programmed using a single programming device.

With regard to the variability of the programming device, it has proved advantageous for the programming head to be detachably connected to the holding device. This embodiment enables the programming head to be detached from the holding device and then exchanged for another programming head. The programming heads can be exchanged without tools, for example a programming head can be removed from the holding device by hand and another programming head can then be fitted to the holding device. In order to make the programming heads as easy as possible to exchange, said programming heads may be lockable to the holding device. This guarantees a reliable connection, on the one hand, and simple, intuitive assembly and dismantling without the additional use of tools, on the other. Furthermore, it is also possible for each programming head to be fixedly connected to a holding device and for the corresponding holding device also to be exchanged when the programming heads are exchanged. The holding device can therefore be detachably connected to the drive device.

Furthermore, a changing device for the automatic exchange of the programming heads can also be provided. By means of the automatic changing device, the programming heads can be automatically detached from the holding device. Once the programming heads have been detached, they can be stowed in a magazine. Likewise, by means of the changing device, a programming head can be removed from the magazine and then connected to the holding device. The changing device therefore allows the programming heads to be changed purely automatically and not necessarily by manual means. This automation speeds up and simplifies the entire programming operation.

It has further proved advantageous for a set of different programming heads, in particular comprising a contactless programming head, such as an induction programming head, and a contact programming head to be provided. When exchanging the programming head, the different programming heads of the set can therefore be used and, depending on the munition body being programmed, a programming head can be selected from the set. The different programming heads can be stored in a magazine and selectively removed from said magazine, depending on the munition body being programmed.

With regard to an embodiment of the programming head, also irrespective of the set, it has proved advantageous for said programming head to be designed as a contactless programming head, in particular as an induction programming head, or as a contact programming head. Many munition bodies can only be programmed contactlessly by means of an induction programming head, for example, whereas others require a contact programming head which is in direct contact with the munition body during programming. To this extent, different munition bodies and munition body types can be programmed by the different programming heads using the same programming device.

As a development, it is proposed that different programming heads, which can be used selectively, are arranged on the holding device. With this embodiment, the programming heads used for programming can likewise be exchanged, but it is not necessary for unused programming heads to be removed from the holding device. The programming heads may be arranged on the holding device in the manner of a revolver, for example, and depending on the munition body being programmed, a programming head for programming the munition body can then be selected by rotating the revolver accordingly. Although this embodiment has a greater space requirement, it allows different programming heads to be exchanged very quickly and can be automated comparatively easily.

With regard to an embodiment of the contact programming head, it has proved advantageous for said contact programming head to have a programming contact surface for making contact with a munition body contact surface. During programming, programming data can be transferred from the programming head via the programming contact surface to the munition body contact surface. The munition body may have a processor, to which the corresponding programming data is fed via the munition body contact surface, and which can be programmed in this way. During programming, the programming contact surface may lie against the munition body contact surface with as full a face as possible, so that a reliable signal and data transfer is guaranteed. The signal and data transfer runs primarily from the programming head to the munition body. Nevertheless, a corresponding confirmation signal, in the manner of a kind of checksum signal, for example, can also be transmitted from the munition body to the programming head after programming has taken place.

It may be advantageous for the programming contact surface to be configured as a surface contact and for the munition body contact surface likewise to be configured as a surface contact. The two surfaces must be brought into contact with one another for data transfer, but a corresponding surface contact allows large tolerances, in particular with regard to the position of the munition body. This is because a reliable signal transfer can be guaranteed even when there is only slight contact between the two surfaces.

In an alternative embodiment, the programming contact surface and the munition body contact surface may also be configured in the manner of a plug connection. This embodiment may be difficult to implement in practice, however, since unlike the making of surface contact, only substantially smaller deviations and tolerances can be accepted, in particular with regard to the position of the munition body.

With regard to an embodiment of the programming contact surface, it has proved advantageous for this to have a stepped configuration. This configuration allows a reliable signal and data transfer to the munition body to be achieved, since the contact surface between a stepped programming contact surface and a correspondingly configured munition body contact surface is greater in size.

With regard to the contactless programming head, it has proved advantageous for this to be configured as a ring-shaped induction programming head. The ring-shaped embodiment allows the induction programming head to be guided contactlessly via a munition body which is to be programmed, in particular the tip of the munition body, so that it can then be programmed contactlessly. Due to the contactless signal transmission, greater tolerances, particularly with regard to the precise positioning of the munition body, can be tolerated. Irrespective of this, the data rate to be achieved with contactless programming is smaller, however, than with contact programming.

Furthermore, it has proved advantageous for the programming head to be movable back and forth between a park position and a programming position. In the programming position, the munition body being programmed can be programmed via the programming device or via the programming head, in that corresponding programming data are transferred from the programming head to the munition body. In the park position, no corresponding signals can be transmitted and the programming head is located in a position remote from the munition body. In the park position, the munition body can be moved without this leading to damage or a collision with the programming head.

It has further proved advantageous for a drive device for moving the programming head to be provided. The drive device may comprise an electric motor and/or a hydraulic motor and ensure that the programming head can be moved back and forth between the park position and the programming position. Furthermore, electrical energy for the programming head can also be provided via the drive device. When the programming device is deployed in a military vehicle, the drive device can be connected to the onboard power supply, so that it can be supplied with electrical, or possibly also hydraulic, energy via the vehicle.

With regard to the movement of the programming head, it has proved advantageous for the programming device to be configured in such a manner that the programming head can be moved in a radial direction to the munition body longitudinal axis of a munition body being programmed. Through a corresponding radial movement to the munition body longitudinal axis, the munition body can be moved in an axial direction when the programming head is in the park position. To this extent, the programming head does not disturb the munition flow in the park position. This is associated with the fact that munition bodies in the munition flow are usually moved axially to a gun barrel, so in the direction of the munition body longitudinal axis. If the programming head were not movable radially to the munition body longitudinal axis, a corresponding axial movement of the munition body could be negatively affected by the programming head.

With regard to the movement of the programming head, it has further proved advantageous for the programming head to be capable of being swiveled back and forth about a swivel axis between the park position and the programming position. Through this embodiment, the programming head can be moved up into the programming position on the munition body in a structurally simple manner, so that said munition body can then be programmed. Furthermore, however, the programming head can also easily be swiveled away from the munition body again due to its ability to swivel and moved into the park position. Furthermore, structurally speaking, a swivel movement can also be achieved substantially more easily than a linear movement, for example, due to the space conditions. It may be advantageous for the swivel axis to extend perpendicularly to the munition body longitudinal axis.

With regard to the movement of the programming head, it has furthermore proved advantageous for said programming head to be movable linearly, in particular perpendicularly, in respect of the swivel axis, for adjustment to the munition body. The linear movement means that the position of the programming head in the programming position can be set very precisely, so that munition bodies of different sizes, and also differently positioned munition bodies, can be programmed in the same way. Via the longitudinal adjustment, the distance of the programming head from the swivel axis, and therefore also the swivel radius of the programming head during a swivel movement between the park position and the programming position can be changed.

With regard to the holding device, it has proved advantageous for this to be designed as a telescopic device. The embodiment as a telescopic device means that the distance of the programming head from the swivel axis can be set very easily. In order to change the distance, the telescopic device can, for example, be extended, so lengthened, or retracted, in other words shortened. This can take place fully automatically via the drive device. Alternatively or in addition, the programming head itself can also be telescopic. Furthermore, the holding device can also be configured as a manipulator arm, in particular as a multi-axis manipulator arm.

In addition, the holding device may be configured in the manner of a hinged cantilever, wherein the programming head can be arranged on one side of the hinged cantilever and on the opposite side the hinged cantilever can be connected to the drive device in a swiveling manner. To this extent, the swivel axis may extend through the end of the holding device, or of the hinged cantilever, opposite the programming head.

It has furthermore proved advantageous for the programming head to be secured in the park position to prevent accidental movements. This securing means that the programming head can be held purely passively in the park position and there is no need for the drive device to hold the programming head actively in the park position or to have to continually readjust it. In order to secure the programming head, a latching or clamping device may be provided, with which the programming head or the holding device can be engaged in the park position independently. When the programming head is moved from the park position back into the programming position, the drive device must overcome the latching force of the latching device. The corresponding device may be designed as clips, for example, or have a clip of this kind, which allows a reliable, but also structurally very simple, securing of the holding device or of the programming head.

As a development, it has likewise proved advantageous for a limit switch to be provided for detecting the park position of the programming head. Only when the programming head is in the park position is it possible to ensure that the munition body can be moved without damaging the programming head. To this extent, the munition body can only be moved when the limit switch has detected the park position of the programming head.

Furthermore, with regard to the problem referred to above, a projectile rammer with a programming device is proposed, wherein the programming device has the features defined in the preamble of patent claim 1 or in patent claim 1. The advantages already described with regard to the programming device can result.

The projectile rammer may be located behind a gun barrel or behind a breech of a gun barrel and be connected to the gun barrel in the azimuth direction. To this extent, the projectile rammer can then move accordingly when the weapon is being aimed. The projectile rammer may have a tray and a positioning device, with which a munition body lying on the tray can be inserted into the gun barrel. The arrangement of the programming device on the projectile rammer can have an advantage, in particular, that the munition bodies can be introduced into the gun barrel as short a time as possible before said device and then fired. To this extent, losses due to a prolonged period of time between the programming and firing of the munition bodies can be avoided.

Furthermore, the arrangement of the programming device on the projectile rammer has also proved to be advantageous, in that the boundary parameters on which the programming data are based only have to cover the shortest possible distances. This is associated with the fact that that the programming of the munition body usually depends on the position of the gun barrel, among other things. If the programming device were to be further away from the gun barrel in the munition flow, for example, and arranged in the magazine or in the vehicle hull, for example, the corresponding signals would have to be initially transferred from the turret to the vehicle hull via a slip ring, for example. By arranging the programming device on the projectile rammer, a transfer of this kind is not necessary. Furthermore, the programming device may also be arranged on different elements on the turret side, and also straight on the gun barrel, for example.

To this extent, a vehicle with a hull and a turret that can be rotated in respect of the hull is proposed, wherein the programming device is arranged on the turret side. The programming device may be configured in the manner described above.

Furthermore, it has proved advantageous for the programming device to be configured as a retrofitting solution. The programming device may be connectable to the projectile rammer via a screw connection, for example. For example, the drive device can be connected to the projectile rammer, so that the holding device and the programming head can then be moved in respect of the other elements of the projectile rammer. Programming devices are also known in practice, which are moved purely manually by hand in the manner of portable devices. To this extent, the programming device described can replace purely manual programming devices of this kind as retrofitting solutions.

With regard to the projectile rammer, it has furthermore proved advantageous for said rammer to have a tray for receiving a munition body, wherein the programming device is arranged to the side of the tray. When a munition body is fed from the projectile rammer, or from the tray of the projectile rammer, into the gun barrel, it is usually the case that the munition body is inserted into the gun barrel from the tray in an axial direction, in other words in the direction of the munition body longitudinal axis. By positioning the programming device to the side of the tray, this feed movement of the munition body into the gun barrel is not obstructed.

Furthermore, it has proved advantageous for a projectile rammer to have a programming device with two holding devices and two programming heads which are arranged on different sides of the tray. Depending on the munition body being programmed, one of the two programming heads can then be selected and this can be used for programming the munition body. The two programming heads may have different designs to this extent, for example one programming head may be designed as an induction programming head and one programming head as a contact programming head. Depending on the munition body, the corresponding programming head can then be used for programming. This embodiment is particularly characterized by the fact that the programming head of a programming device does not have to be exchanged. Furthermore, it is also possible for more than two programming heads to be provided.

It has furthermore proved advantageous with regard to the projectile rammer for the programming head to be movable from a park position arranged on the other side of the tray into a programming position arranged in the region of the tray, in order to program a munition body located in said tray. The corresponding movement of the programming head in this case advantageously takes place radially or perpendicularly to the longitudinal axis of the munition body.

As a development, it is proposed that the projectile rammer or the programming device has a sensor for detecting the position of the munition body. Furthermore, the position of the munition body contact surface can also be detected by the sensor. With the help of the position of the munition body and the munition body contact surface, it is then possible to determine how far the holding device or the programming head has to be telescoped and how far the programming head has to be swiveled about the swivel axis, in order to ensure reliable programming. Furthermore, it may also be possible to detect via the sensor or, alternatively, a further sensor, what kind of programming head is needed for the programming of the munition body. This can be advantageous, particularly when the programming heads are exchanged automatically, since the entire programming process can then be automated.

Furthermore, with regard to the problem referred to above, a method for programming a munition body with a programming device is proposed, which is configured in the manner described above. The advantages already described with regard to the programming device can result.

BRIEF DESCRIPTION OF THE DRAWINGS

Certain embodiments of invention are to be explained in greater detail below with the help of the drawings of a schematic exemplary embodiment. In the drawings.

DETAILED DESCRIPTION

Figure 1A:
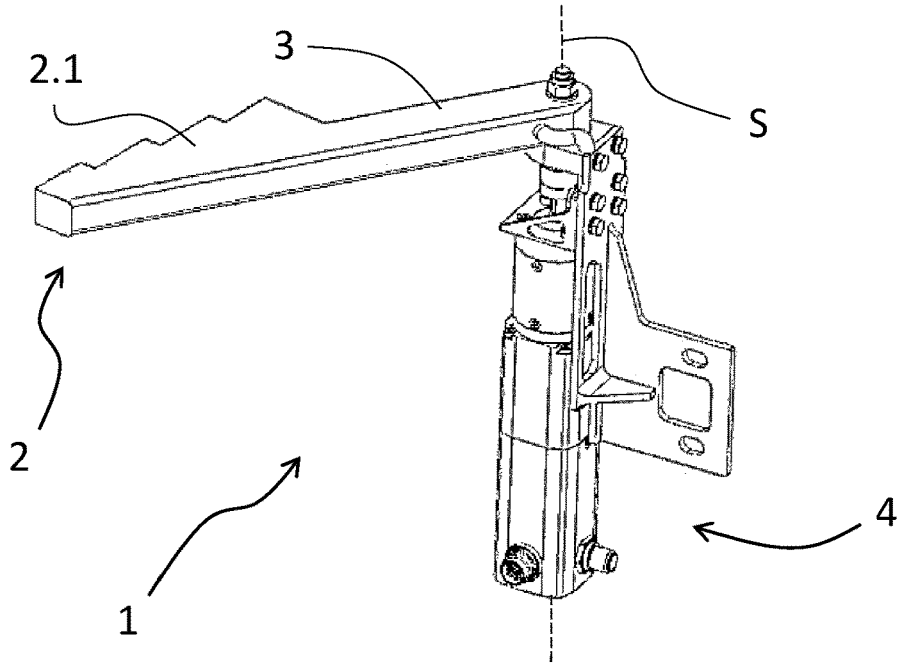
FIG. 1*a* shows a programming device with a contact programming head in a telescoped position.
Figure 1B:
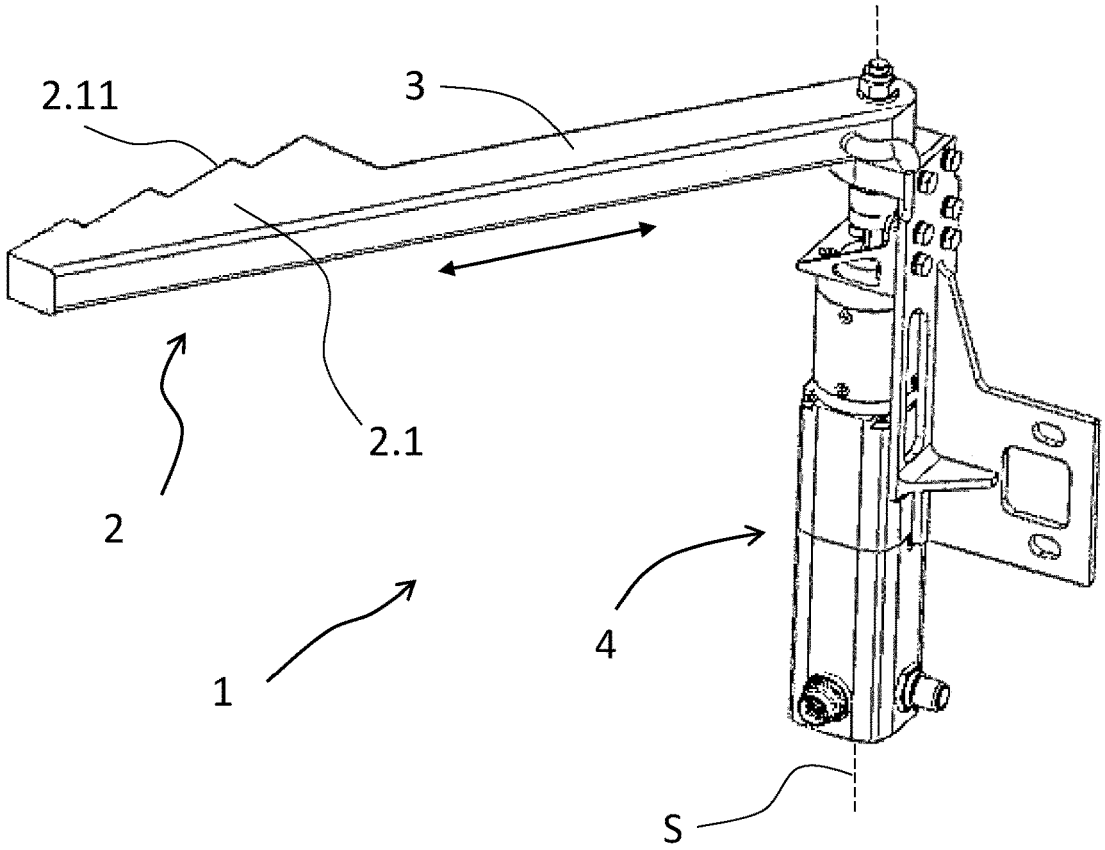
FIG. 1*b* shows a programming device with a contact programming head in a different telescoped position.

A programming device 1 is shown in a perspective side view in the representations in FIGS. 1*a* and 1*b*. Munition bodies 101 can be programmed via the programming device 1, so that they explode at a predetermined time, for example, or follow a predetermined trajectory. Programmable munition bodies 101 of this kind are usually large-caliber munition bodies 101 which can be fired from artillery guns or also from large ships' cannons, for example.

Before the operations involved in programming a munition body 101 are described in greater detail below with the help of FIGS. 4 and 5, the basic structure of the programming device 1 is first to be explained in greater detail with the help of FIGS. 1 to 3.

The programming device 1 has a drive device 4 with a motor and a holding device 3 swivellably connected to the drive device 4, said holding device being able to be swiveled about the swivel axis S via the drive device 4. A programming head 2 is arranged at the end of the holding device 3, said programming head being configured as a contact programming head 2.1 in the case of the embodiment according to FIGS. 1*a* and 1*b*, so that the contact programming head 2.1 can also be moved back and forth about the swivel axis S accordingly.

Moreover, however, the programming head 2 is also linearly movable in relation to the swivel axis S, as can be identified with the help of the double arrow in FIG. 1*b*. In order to allow a corresponding linear movement, the holding device 3 is configured as an extendable telescopic device. In the representation in FIG. 1*a*, the holding device 3 is inserted accordingly and extended in the depiction in FIG. 1*b*. Through this longitudinal adjustment of the programming head 2, said programming head can be adjusted both to the position of the munition body 101 being programmed and to the munition body contact surface 101.1, and also to the size of the munition body 101.

Figure 3A:
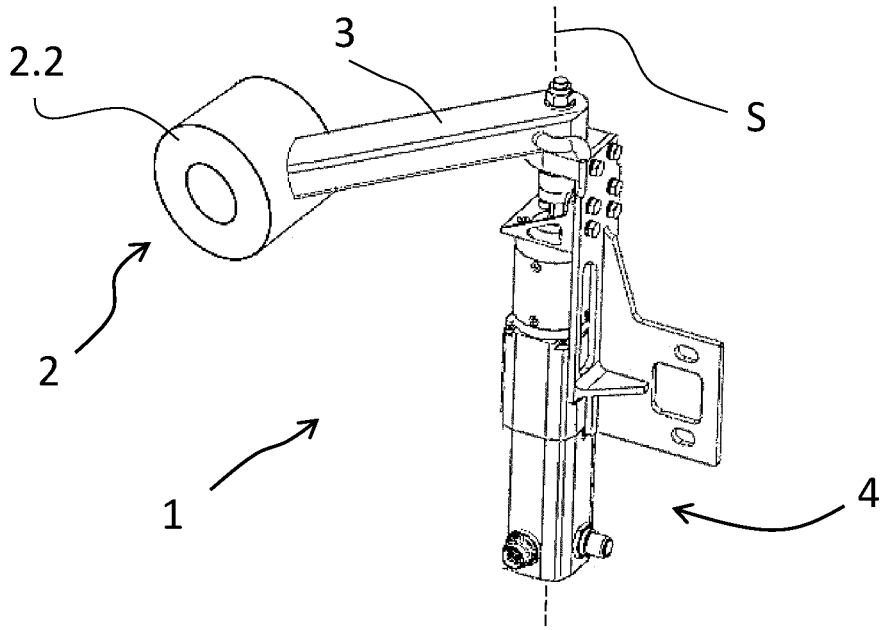
FIG. 3*a* shows the programming device in accordance with FIG. 1*a*, with an induction programming head.
Figure 3B:
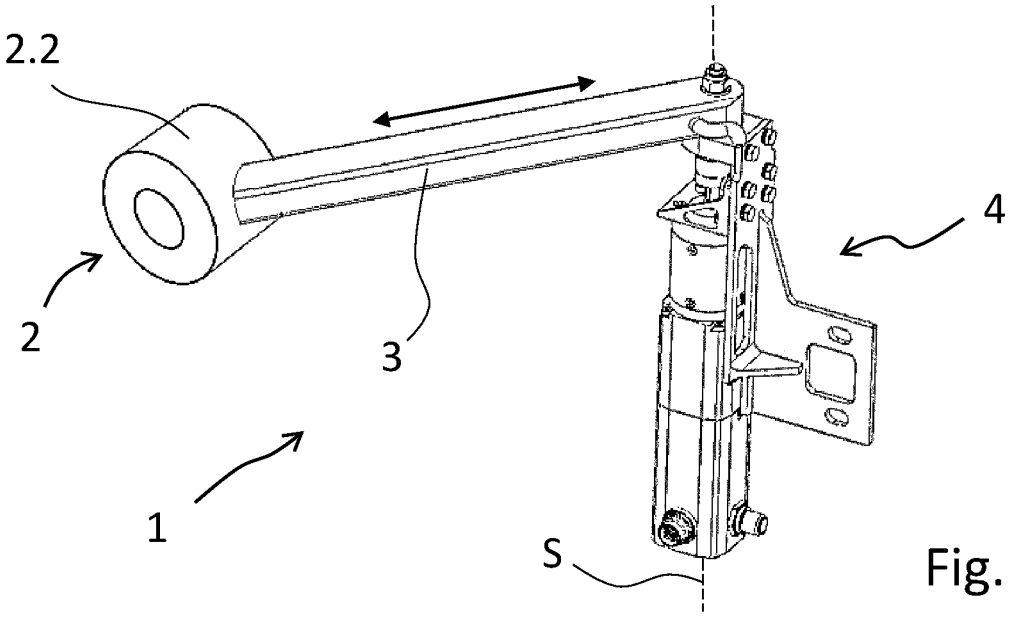
FIG. 3*b* shows the programming device in accordance with FIG. 1*b*, with an induction programming head.

In the depictions in FIGS. 3*a* and 3*b*, a programming device 1 is shown which basically coincides with the programming device in FIGS. 1*a* and 1*b*. The only difference is that the programming head 2 is not configured as a contact programming head 2.1, but as an induction programming head 2.2.

In order to program the munition body 101, the contact programming head 2.1 must be brought into contact therewith, whereas the munition body 101 can be programmed in a contactless manner via the induction programming head 2.2. For contactless programming, the induction programming head 2.2 is moved over the tip of the munition body 101, so that said tip projects into the ring-shaped induction programming head 2.2. The induction programming head 2.2 has a coil with which programming data can then be transferred to the munition body 101. Following successful programming, the induction programming head 2.2 can then be swiveled back about the swivel axis X, as this is explained in even greater detail below for the contact programming head 2.1 with the help of FIGS. 4 and 5.

Furthermore, the programming heads 2 can easily be removed from the holding device 3 or connected thereto. This allows a very simple exchange of an induction programming head 2.2 for a contact programming head 2.1, or vice versa. It is frequently the case in practice that munition bodies 101 of different types are to be fired depending on the target being engaged, for example. Many munition bodies 101 can only be programmed contactlessly, whereas other munition bodies 101 are unsuitable for contactless programming, for example on account of the data rate required for programming, and require programming with a contact programming head 2.1. To this extent, the programming head 2 is, or the programming heads 2 are, configured as programming head modules which can be optionally connected to the holding device 2, depending on the munition body 101 being programmed.

Figure 2:
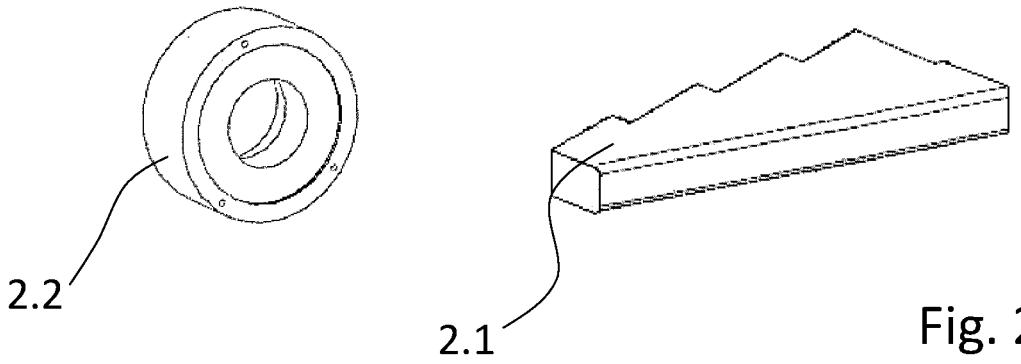
FIG. 2 shows a set of different programming heads comprising an induction programming head and a contact programming head.

In the depiction in FIG. 2, the two different programming heads 2, namely one contact programming head 2.1 and one induction programming head 2.2, are shown once again released from the holding device 2. The two programming heads 2 can be selectively arranged on the holding device 3, depending on what kind of munition body 101 is to be programmed, and stored in a magazine, for example. Depending on the requirement of the munition body being programmed, one of the different programming heads 2 can then be selected and connected to the holding device 3.

Figure 4:
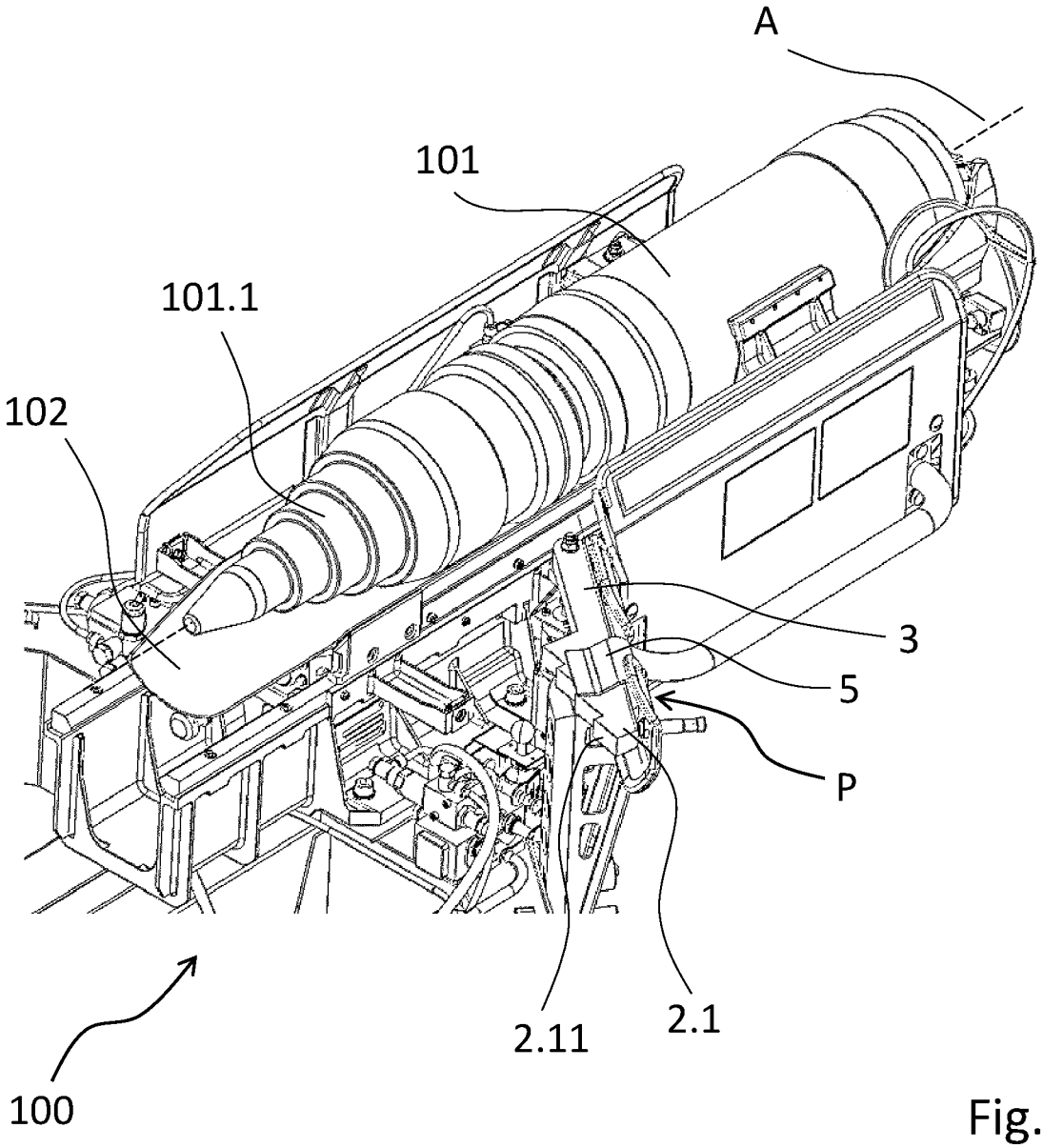
FIG. 4 shows a projectile rammer with a programming device in a park position.
Figure 5:
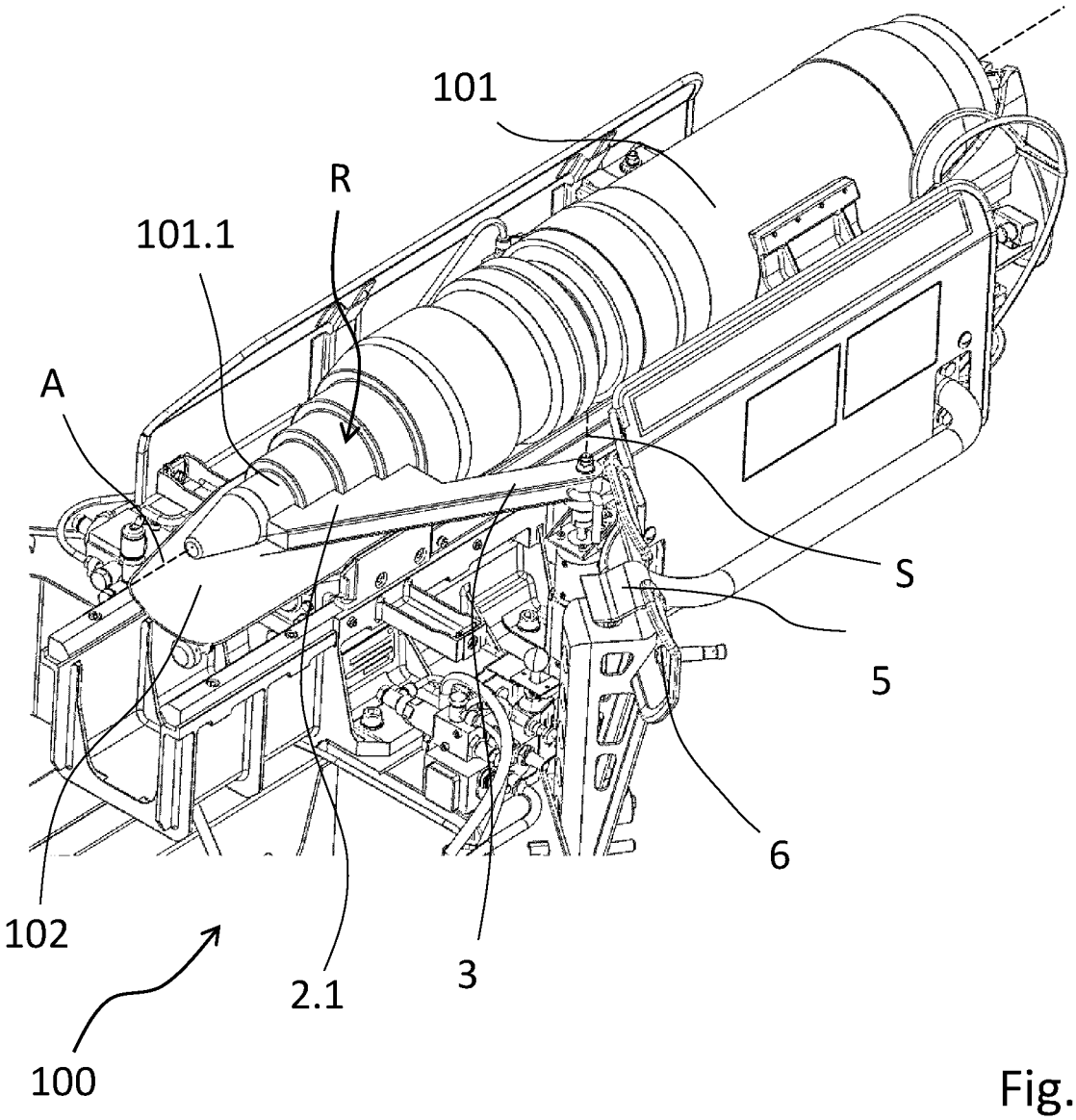
FIG. 5 shows the projectile rammer according to FIG. 4 in a programming position.

With the help of FIGS. 4 and 5, the individual operations involved in programming a munition body 101 with a programming device 1 which has a contact programming head 2.1 are described in greater detail. When programming a munition body 101 with an induction programming head 2.2, the corresponding operations are basically identical.

A projectile rammer 100, which is arranged behind a gun barrel which is not shown, is illustrated in the depiction in FIG. 4, and therefore represents the last station before the gun barrel in the munition flow of a munition body 101 from the munition magazine to the gun barrel. This projectile rammer is connected, at least in the azimuth direction, to the gun barrel or to the rotatable turret. The projectile rammer 100 has a tray 102 on which the munition body 101 being programmed rests. When the munition body 101 has been programmed by the programming device 1, in a following step it is inserted into the gun barrel in the direction of the munition body longitudinal axis A and then fired.

As can be seen in FIG. 4, the programming device 1 is initially still located in the park position P, as the programming head 2 does not yet rest against the munition body 101. The programming head 2 or the holding device 3 is secured via a latching device 5 in the park position P, so that said programming head 2 cannot be accidentally moved, something that is to be feared due to vibrations and movements, particularly during rapid all-terrain driving.

The programming of the munition body 101 can begin when the munition body 101 is in the position shown in FIG. 4 and is not moved. The drive device 4 is activated for this purpose and it swivels the holding device 3 along with the programming head 2 in a clockwise direction about the swivel axis S, as a result of which the holding force of the latching device 5 also has to be overcome.

When the programming head 2 has reached the programming position R depicted in FIG. 5, the stair-shaped contact area 2.11 of the contact programming head 2.1 rests on the correspondingly configured munition body contact surface 101.1 of the munition body 101. In this programming position R, the respective contact surfaces are therefore in contact and programming data can be transferred from the programming head 2 via the munition body contact surface 101.1 to a process or the munition body 101 which is not depicted.

As has already been described in relation to FIGS. 1*a* and 1*b*, it is also possible for the holding device 3 to be extended or retracted, so that an adjustment to the precise position of the munition body contact surface 101.1 can thereby be achieved.

When the programming operation is complete, the programming head 2 is swiveled along with the holding device 3 back in a counterclockwise direction into the park position P depicted in FIG. 4. The programming head 2 then strikes against a limit switch 6 during this. Only when the programming head 2 rests against the limit switch 6 can the munition body 101 be moved on and inserted into the gun barrel. Without this additional securing, damage could be inflicted on the programming device 1, when the munition body 101 has already been moved, when the programming head 2 has not yet reached the park position.

REFERENCE SIGNS

1 Programming device
2 Programming head
2.1 Contact programming head
2.11 Programming contact surface
2.2 Induction programming head
3 Holding device
4 Drive device
5 Locking device
6 Limit switch
100 Projectile rammer
101 Munition body
101.1 Munition body contact surface
102 Tray
A Munition body longitudinal axis
P Park position
R Programming position
S Swivel axis Having described the invention in detail and by reference to the various embodiments, it should be understood that modifications and variations thereof are possible without departing from the scope of the claims of the present application.

What is claimed is:

1. A programming device for programming of munition bodies, having a holding device to which a programming head for transmission of programming data to a munition body of the munition bodies is fastened, wherein the programming head is configured as an exchangeable programming head module so that munition bodies of different types can be programmed with the programming device, wherein the programing device includes a plurality of different programming heads, each of which is configured to communicate with a particular type of munition body such that an appropriate one of the programming heads can be selected and removably fastened to the holding device based upon the type of the particular munition body.

2. The programming device as claimed in claim 1, wherein the programming head is removably fastened to the holding device.

3. The programming device as claimed in claim 1, wherein the programming head is designed as a contactless programming head.

4. The programming device as claimed in claim 1, wherein the programming head has a programming contact surface for making contact with a munition body contact surface, wherein the programming contact surface has a stair-shaped design.

5. The programming device as claimed in claim 1, wherein the programming head is movable back and forth between a park position and a programming position.

6. The programming device as claimed in claim 5, wherein the programming head is secured in the park position to prevent unintentional movements.

7. The programming device as claimed in claim 5, including a limit switch for detecting the park position of the programming head.

8. The programming device as claimed in claim 1, wherein the holding device is designed as a telescopic device.

9. A method for programming a munition body with a programming device according to claim 1, the method including the programming head transmitting programming data to the munition body.

10. A programming device for programming of munition bodies, having a holding device to which a programming head for transmission of programming data to a munition body of the munition bodies is fastened, wherein the programming head is configured as an exchangeable programming head module so that munition bodies of different types can be programmed with the programming device, wherein the programming device is configured in such a manner that the programming head is movable radially to a longitudinal axis of a munition body being programmed.

11. A programming device for programming of munition bodies, having a holding device to which a programming head for transmission of programming data to a munition body of the munition bodies is fastened, wherein the programming head is configured as an exchangeable programming head module so that munition bodies of different types can be programmed with the programming device, wherein the programming head is movable back and forth between a park position and a programming position, wherein the programming head is capable of being swiveled back and forth about a swivel axis between the park position and the programming position.

12. The programming device as claimed in claim 11, wherein the programming head is movable linearly in respect of the swivel axis for adjustment to the munition body.

13. A projectile rammer with a programming device for programming of munition bodies, the programming device having a holding device to which a programming head for transmission of programming data to a munition body of the munition bodies is fastened, wherein the programming head is configured as an exchangeable programming head module so that munition bodies of different types can be programmed with the programming device.

14. The projectile rammer as claimed in claim 13, including a tray for receiving a munition body wherein the programming device is arranged to a side of the tray.

15. The projectile rammer as claimed in claim 14, wherein the programming head for programming the munition body located in the tray is movable from a park position arranged on an other side of the tray into a programming position arranged in a region of the tray.

* * * * *